US009523227B1

(12) United States Patent
Huang

(10) Patent No.: US 9,523,227 B1
(45) Date of Patent: Dec. 20, 2016

(54) ANTI-DROP SAFETY DEVICE ASSEMBLY

(71) Applicant: Nan Juen International Co., Ltd., New Taipei (TW)

(72) Inventor: Kuo-Sheng Huang, New Taipei (TW)

(73) Assignee: Nan Juen International Co., Ltd., New Taipei (TW)

( * ) Notice: Subject to any disclaimer, the term of this patent is extended or adjusted under 35 U.S.C. 154(b) by 0 days.

(21) Appl. No.: 14/813,835

(22) Filed: Jul. 30, 2015

(51) Int. Cl.
*E05D 13/00* (2006.01)
*E05F 5/06* (2006.01)

(52) U.S. Cl.
CPC ..... *E05D 13/006* (2013.01); *E05F 5/06* (2013.01); *Y10T 16/5383* (2015.01)

(58) Field of Classification Search
CPC ..... E05D 13/006; E05D 13/1223; E05D 13/1246; E05F 5/06; E05F 3/02; E05F 3/18; E05F 3/20; Y10T 16/5383; Y10T 16/61; Y10T 16/62; Y10T 16/625; Y10T 16/2771; Y10T 16/283; Y10T 16/304; Y10T 16/53836
USPC ..... 16/286, 82, 84, 85, 54, 68, 50, 291
See application file for complete search history.

(56) References Cited

U.S. PATENT DOCUMENTS 769,201 A * 9/1904 Hitz et al. ..... E05F 5/02 16/286
6,591,454 B2 * 7/2003 Brustle ..... E05F 5/006 16/374
7,275,284 B2 * 10/2007 Lautenschlager ..... E05D 3/142 16/287
7,669,285 B2 * 3/2010 Gallasch ..... E05F 5/006 16/286
7,712,185 B2 * 5/2010 Pyo ..... E05F 5/006 16/250
7,730,582 B2 * 6/2010 Migli ..... E05F 5/006 16/254
7,987,555 B2 * 8/2011 Chen ..... E05D 15/582 16/286
8,561,765 B2 * 10/2013 Chen ..... E05F 5/02 16/50
8,601,644 B1 * 12/2013 Chen ..... E05F 5/006 16/286
8,621,713 B2 * 1/2014 Zimmer ..... E05F 5/006 16/286
2008/0109987 A1 * 5/2008 Chen ..... E05F 5/10 16/68

* cited by examiner

*Primary Examiner* — William Miller

(57) ABSTRACT

An anti-drop safety device assembly includes a hinge including a first hinge plate and a second hinge plate hinged together, a bumper assembly including a first positioning member pivoted to the first hinge plate, a second positioning member movably in and out of the first positioning member and a bumper connected between the first and second positioning members, and an anti-drop device including a connection member inserted through the second hinge plate and pivoted to the second positioning member and a friction pad mounted at the top side of the connection member for creating a friction force between the anti-drop device and the flip door panel to prevent the flip door panel from dropping suddenly when the flip door panel is pulled by the anti-drop device out of the top side of the cabinet.

3 Claims, 13 Drawing Sheets

ANTI-DROP SAFETY DEVICE ASSEMBLY

BACKGROUND OF THE INVENTION

1. Field of the Invention

The present invention relates to safety device technology and more particularly, to an anti-drop safety device assembly for use in a flip door system to prevent the door panel from rapidly flipping down.

2. Description of the Related Art

For the advantages of ease of use and space saving, slidable flip-up door panels are widely used in office furniture, filing cabinets, kitchen cabinets, wardrobes, bookcases, wall cabinets, and TV cabinets. In application, the user can flip up the door panel and then push the opened door panel inwardly to the top side of the cabinet, or pull the door panel out of the top side of the cabinet and then turn it down to close on the front open side of the cabinet. However, if the door panel is pulled out of the top side of the cabinet by the user and accidentally slipped from the user's hand, the gravity weight of the door panel will force it to drop rapidly, leading to injuries.

SUMMARY OF THE INVENTION

The present invention has been accomplished under the circumstances in view. It is therefore the main object of the present invention to provide an anti-drop safety device assembly, which is practical for use in a flip door panel of a cabinet and capable of creating a friction force to prevent the flip door panel from dropping suddenly when the flip door panel is being pulled out of the top side of the cabinet, assuring a high level of safety.

To achieve this and other objects of the present invention, an anti-drop safety device assembly comprises a hinge comprising a first hinge plate and a second hinge plate hinged together, a bumper assembly comprising a first positioning member pivoted to the first hinge plate, a second positioning member movably in and out of the first positioning member and a bumper connected between the first and second positioning members, and an anti-drop device comprising a connection member inserted through the second hinge plate and pivoted to the second positioning member and a friction pad mounted at the top side of the connection member.

Thus, after fixation of the second hinge plate to the flip door panel assembly and when the door panel of the flip door panel assembly is driven to bias the second hinge plate toward the first hinge plate, i.e., when the door panel is pulled out of the top side of the cabinet and turned downwards, the bumper assembly will be activated by the downward movement of the door panel to force the connection member against the friction pad according to lever principle, creating a friction force between the door panel and the friction pad and preventing the door panel from dropping suddenly.

DETAILED DESCRIPTION OF THE PREFERRED EMBODIMENT

Figure 1:
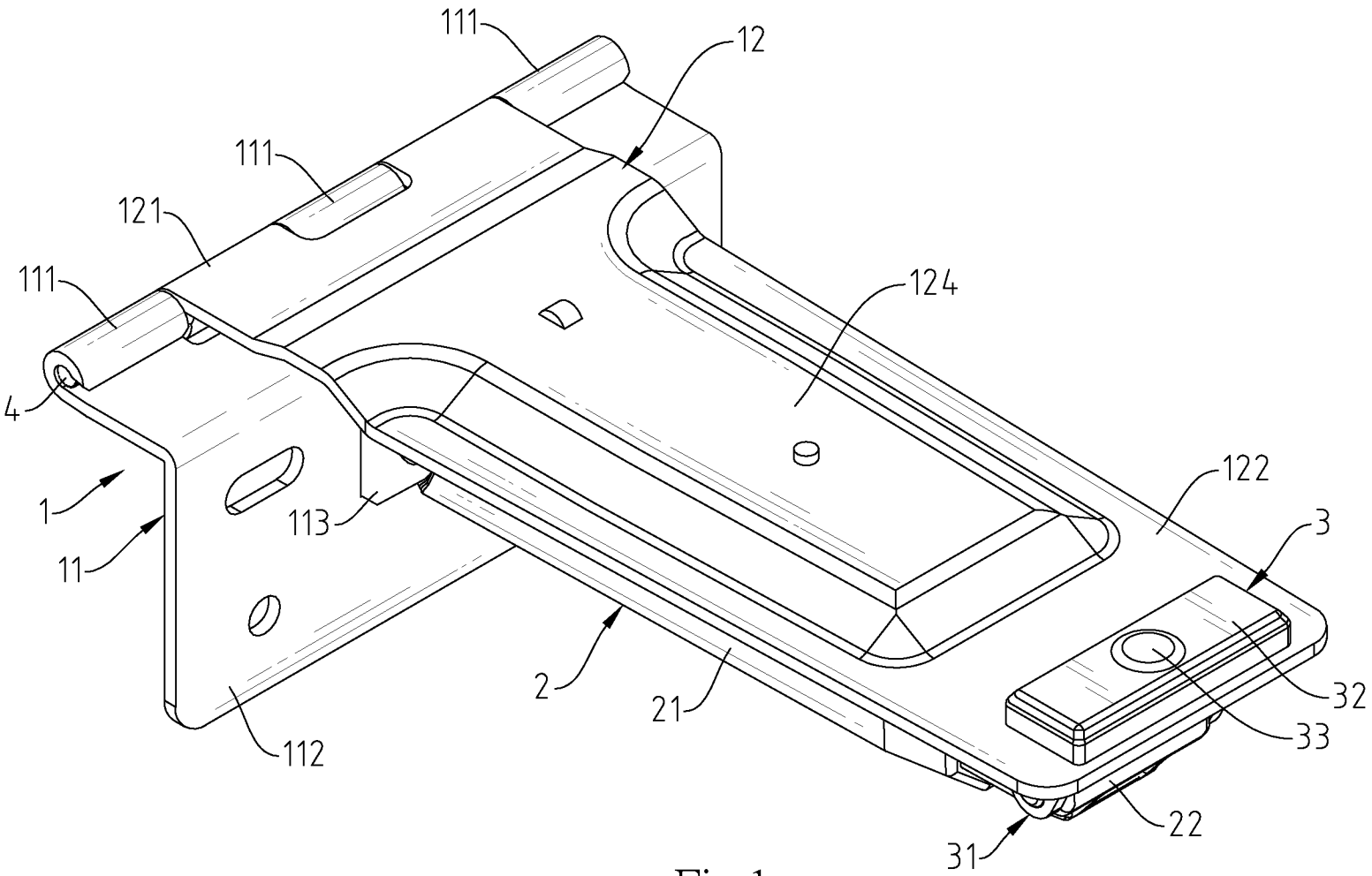
FIG. 1 is an oblique top elevational view of an anti-drop safety device assembly in accordance with the present invention.
Figure 2:
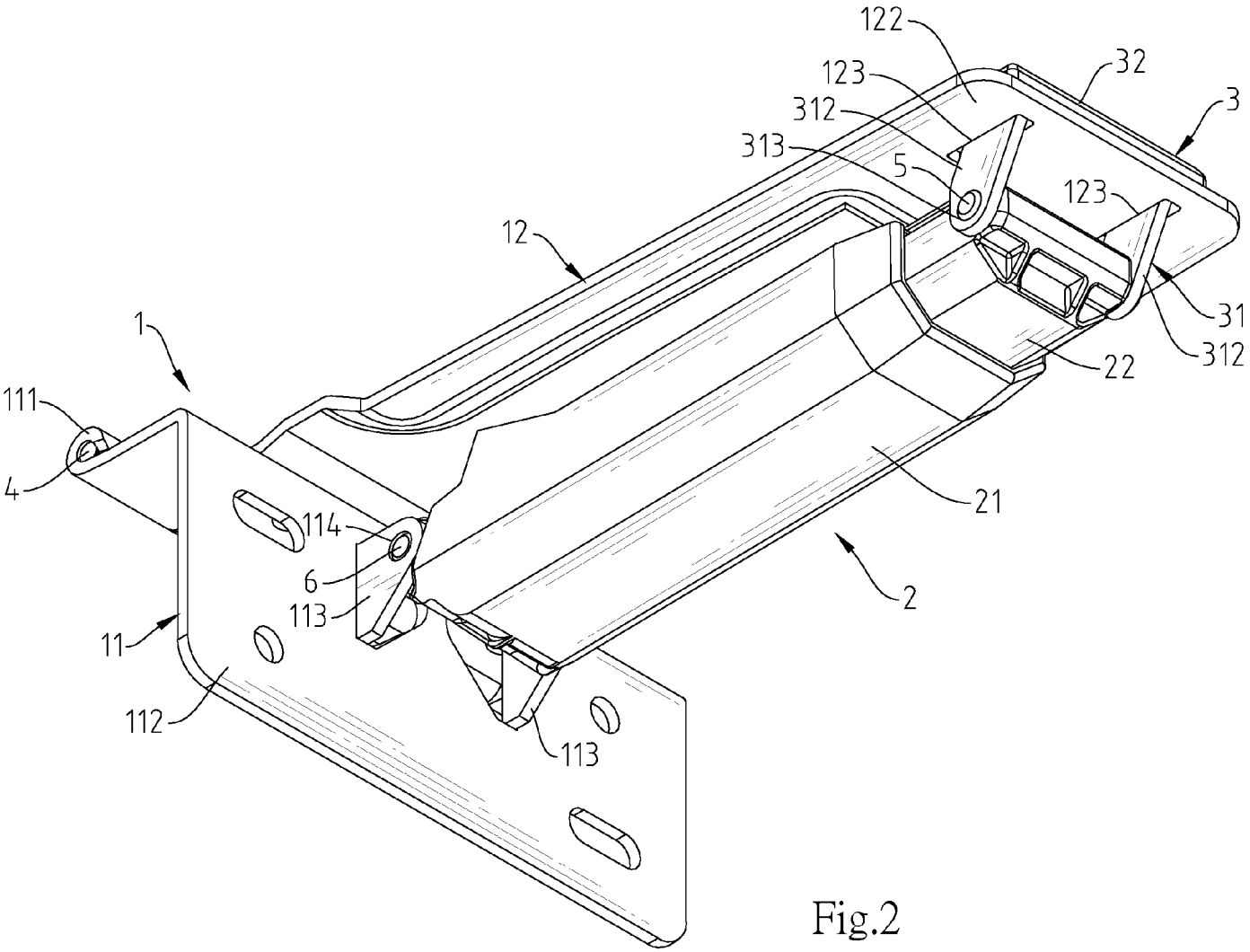
FIG. 2 is an oblique bottom elevational view of the anti-drop safety device assembly in accordance with the present invention.
Figure 3:
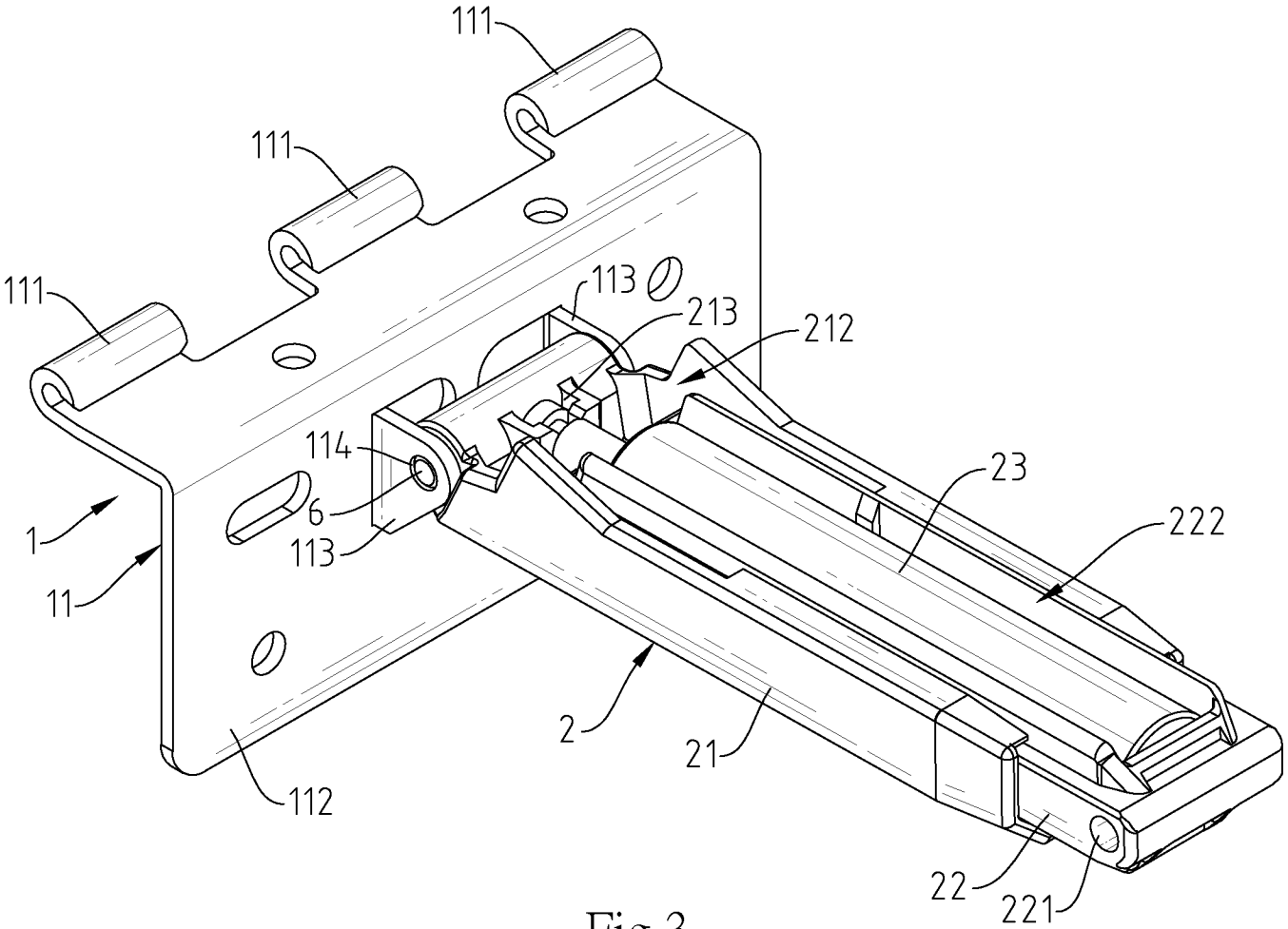
FIG. 3 is an oblique top elevational view of the present invention after removal of the second hinge plate and the anti-drop device.
Figure 4:
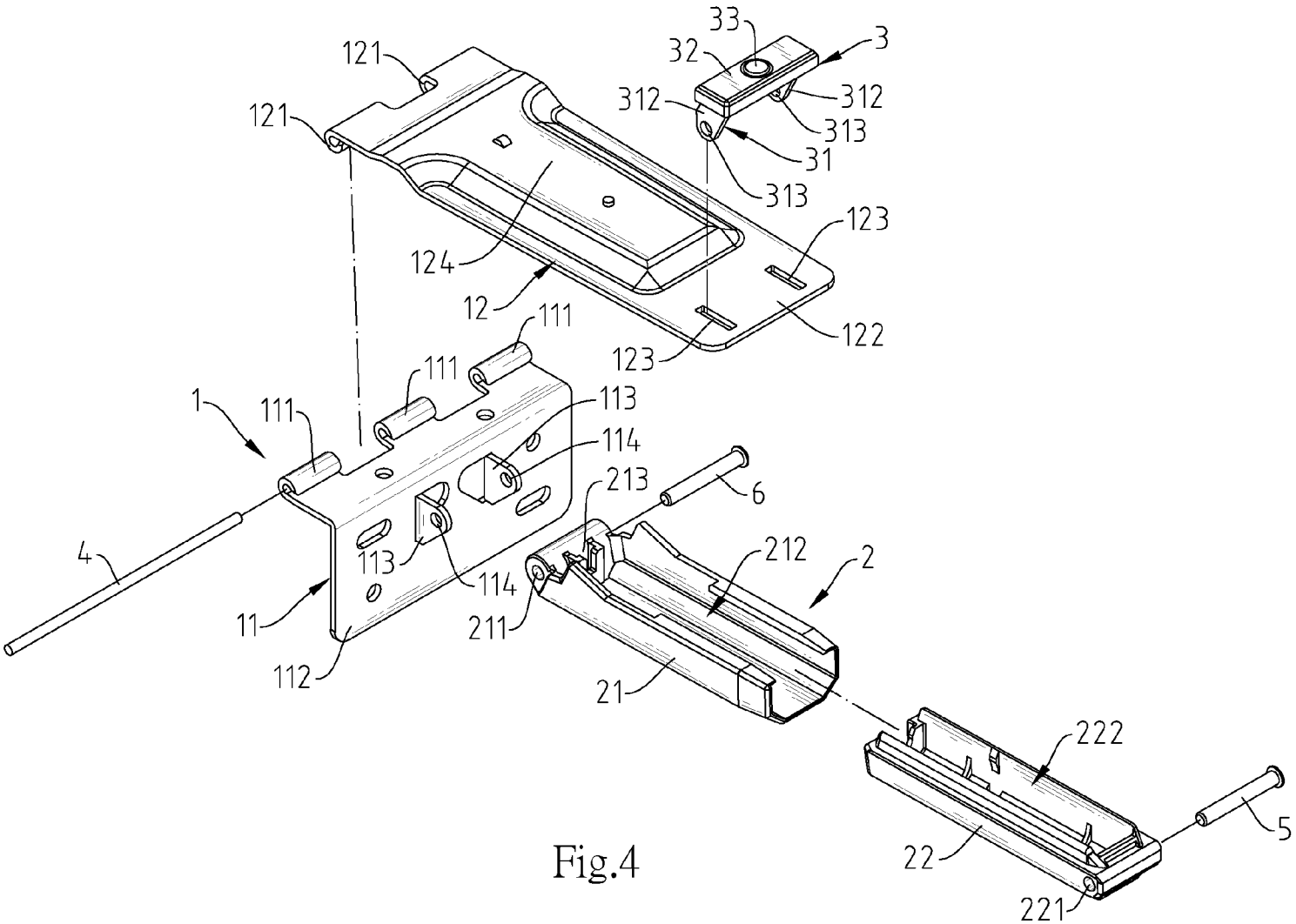
FIG. 4 is an exploded view of the anti-drop safety device assembly in accordance with the present invention (I).
Figure 5:
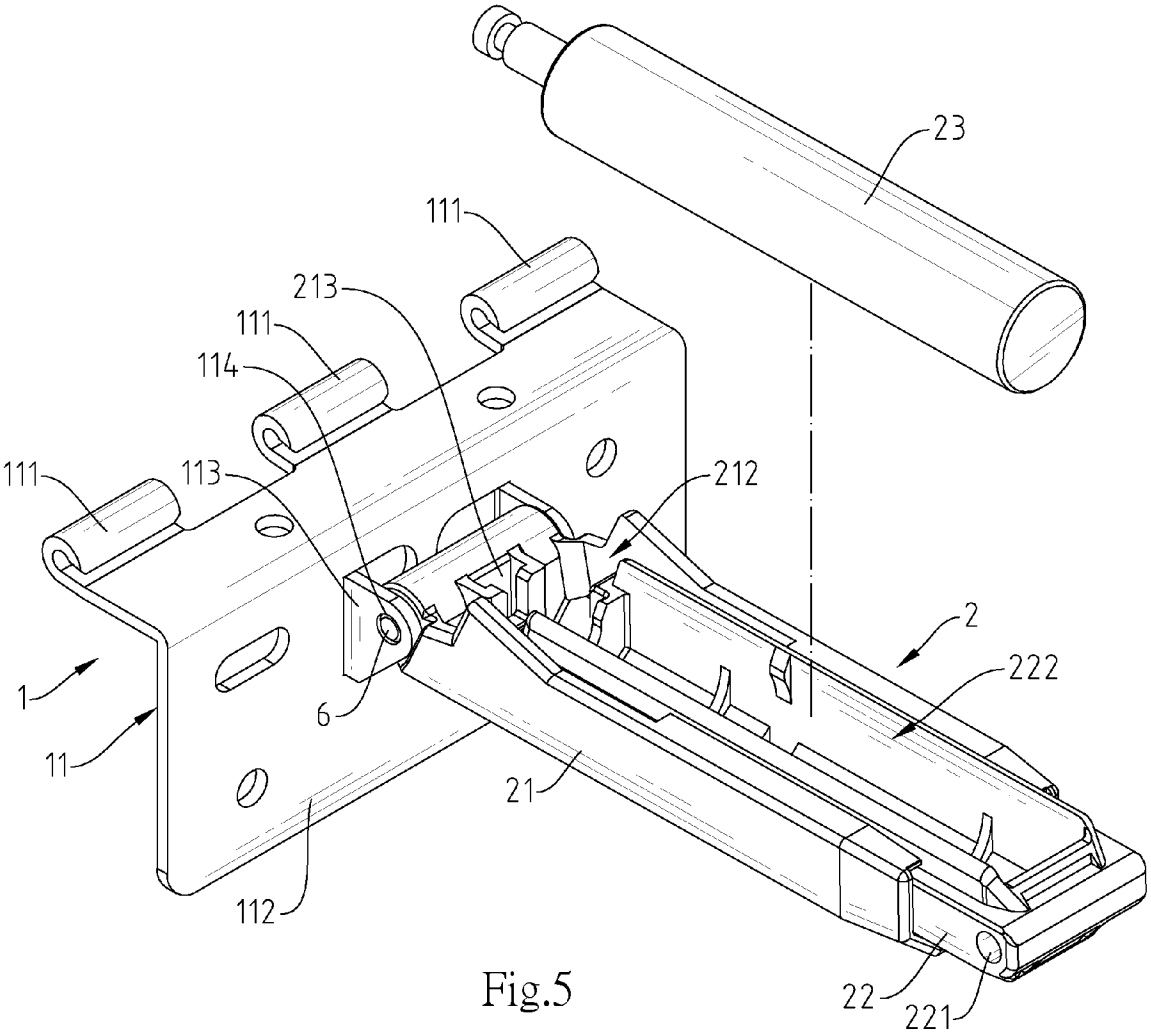
FIG. 5 is an exploded view of the anti-drop safety device assembly in accordance with the present invention (II).
Figure 6:
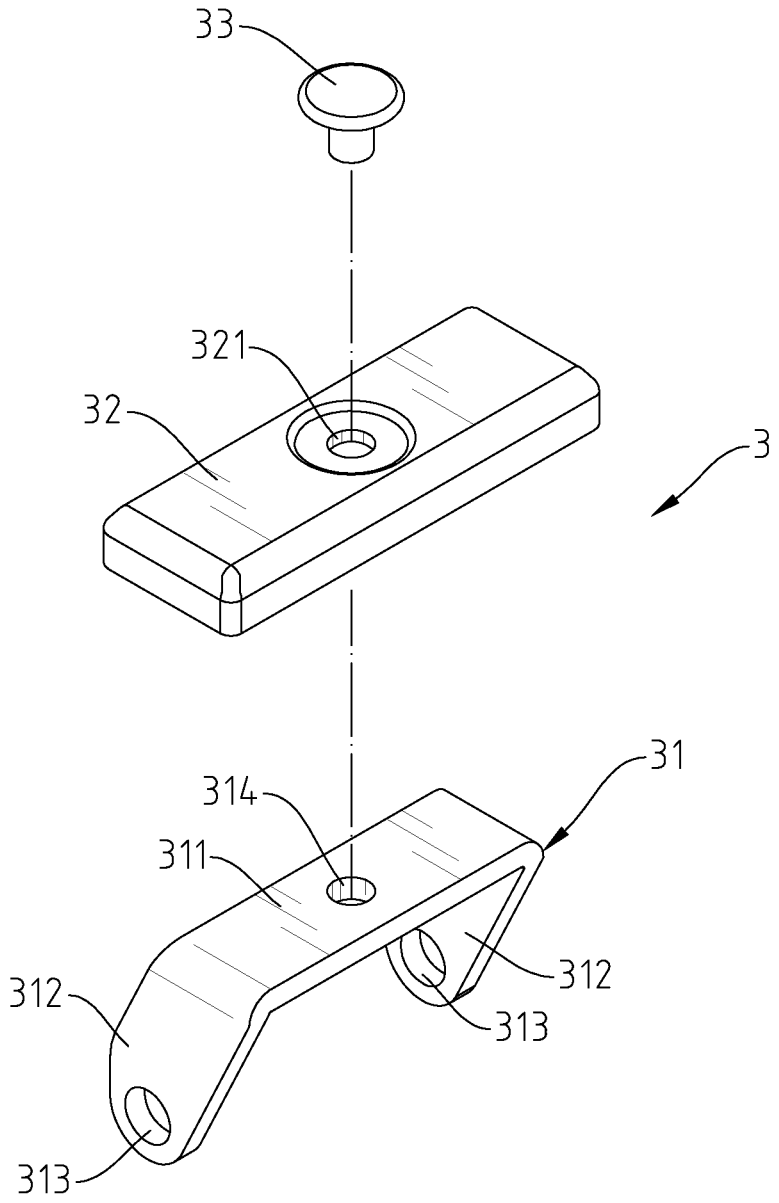
FIG. 6 is an exploded view of the anti-drop device of the anti-drop safety device assembly in accordance with the present invention.
Figure 7:
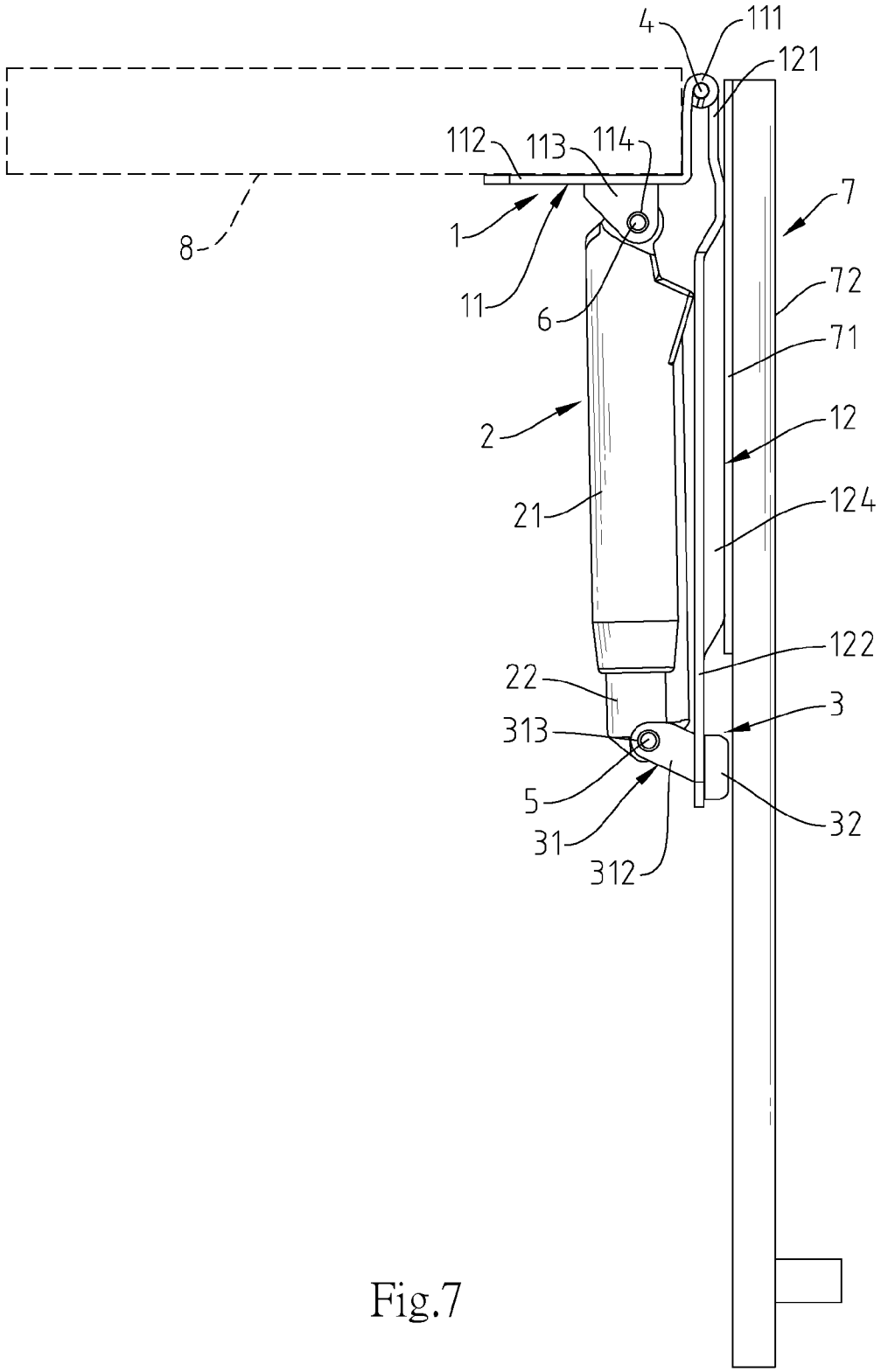
FIG. 7 is a schematic applied view of the anti-drop device of the anti-drop safety device assembly in accordance with the present invention (I).
Figure 8:
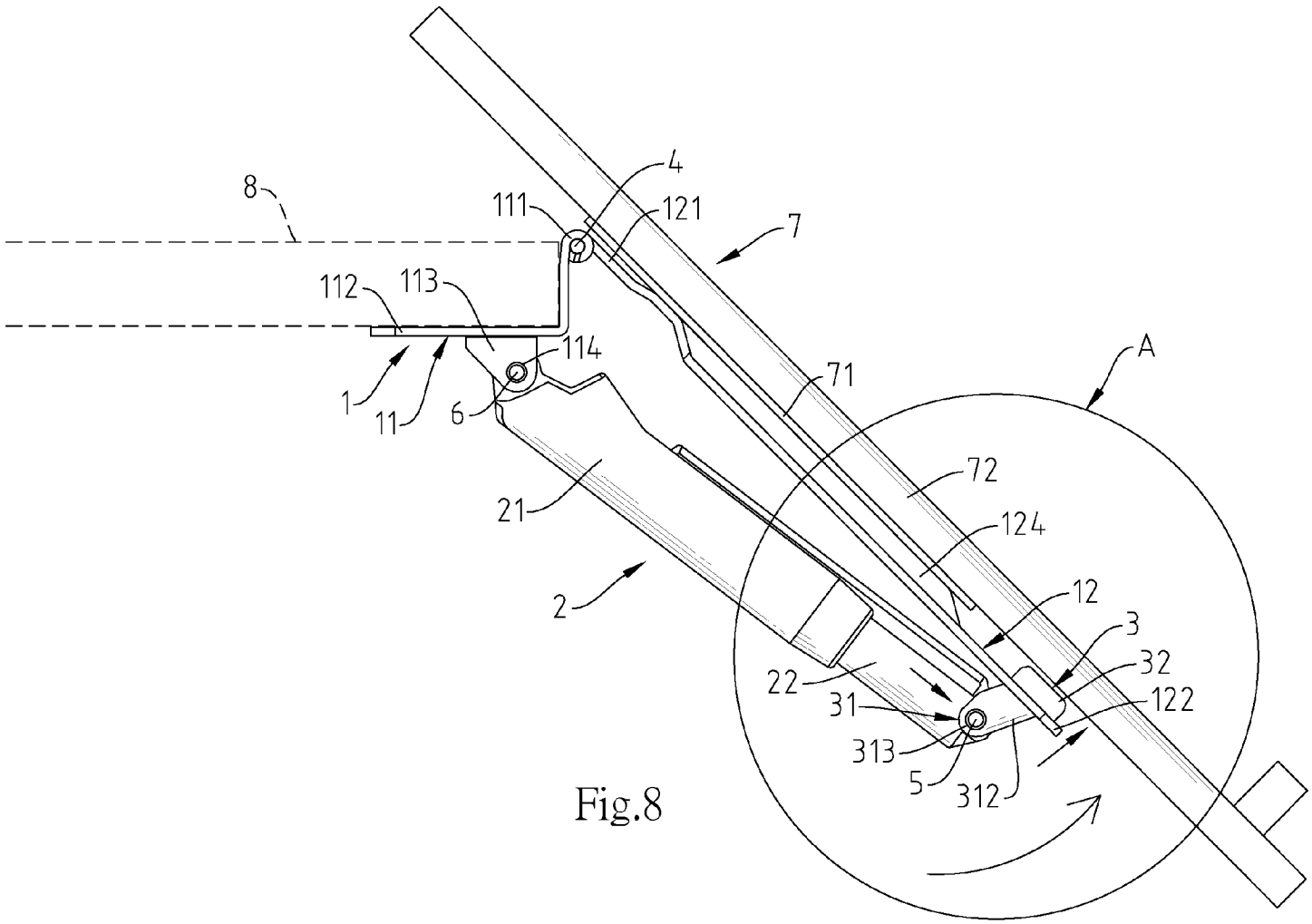
FIG. 8 is a schematic applied view of the anti-drop device of the anti-drop safety device assembly in accordance with the present invention (II).
Figure 9:
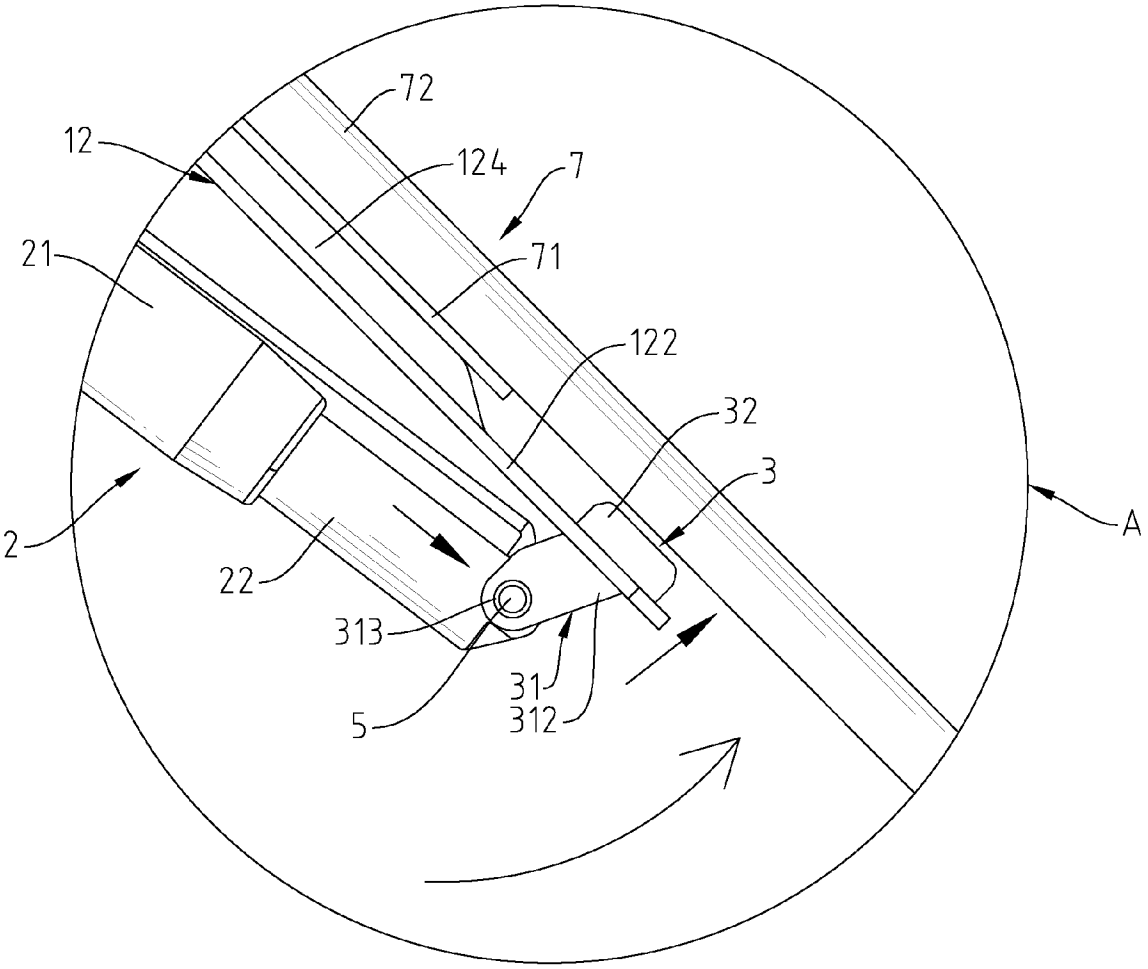
FIG. 9 is an enlarged view of Part A of FIG. 8.
Figure 10:
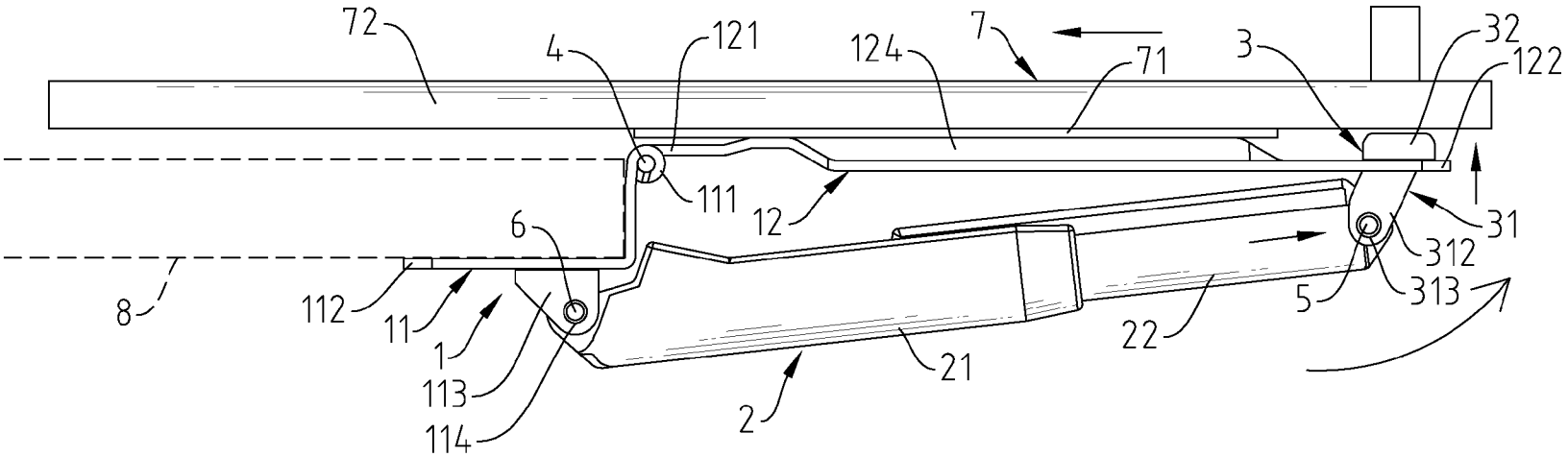
FIG. 10 is a schematic applied view of the anti-drop device of the anti-drop safety device assembly in accordance with the present invention (III).

Referring to FIGS. 1-6, an anti-drop safety device assembly in accordance with the present invention is shown. The anti-drop safety device assembly comprises a hinge 1, a bumper assembly 2 and an anti-drop device 3.

The hinge 1 comprises a first hinge plate 11 and a second hinge plate 12. The first hinge plate 11 comprises a first pivot connection end 111 located at one end thereof, a coupling end 112 located at an opposite end thereof, at least one, for example, two struts 113 located at the coupling end 112, and a pivot hole 114 located at each strut 113. The second hinge plate 12 comprises a second pivot connection end 121 located at one end thereof, a position-limit end 122 located at an opposite end thereof, two position-limit holes 123 bilaterally located at the position-limit end 122, a connection portion 124 connected between the second pivot connection end 121 and the position-limit end 122. Further, the first pivot connection end 111 of the first hinge plate 11 and the second pivot connection end 121 of the second hinge plate 12 are pivotally connected together with a pivot pin 4.

The bumper assembly 2 comprises a first positioning member 21, a second positioning member 22, and a bumper 23. The bumper 23 can be an elastic member, pneumatic cylinder or hydraulic cylinder. In this embodiment, the bumper 23 is a pneumatic cylinder. The first positioning member 21 comprises a sliding groove 212 extending along the length thereof. The second positioning member 22 is accommodated in the sliding groove 212 of the first positioning member 21 and movable in and out of the sliding groove 212. The first positioning member 21 further comprises a first axle hole 211 transversely disposed at one end thereof remote from the second positioning member 22, and a positioning groove 213 located in an inner end wall of the sliding groove 212 adjacent to the first axle hole 211. The second positioning member 22 comprises a second axle hole 221 located at one end thereof remote from the first positioning member 21, and a positioning chamber 222 defined therein. Further, the bumper 23 has two opposite ends thereof respectively positioned in the positioning groove 213 of the first positioning member 21 and the positioning chamber 222 of the second positioning member 22. Further, the first axle hole 211 of the first positioning member 21 is pivotally connected to the pivot hole 114 of the hinge 1 with a pivot pin 6.

The anti-drop device 3 comprises a connection member 31, and a friction pad 32 located at a top side of the connection member 31. The connection member 31 comprises a base 311, two legs 312 respectively extended from two opposite lateral sides of the base 311 in one same direction, a through hole 313 located at a distal end of each leg 312, and a mounting hole 314 located at the base 311 on the middle. The friction pad 32 comprises a countersunk hole 321. Further, a fastening member (such as screw bolt or rivet) 33 is mounted in the countersunk hole 321 of the friction pad 32 and fastened to the mounting hole 314 to affix the friction pad 32 to the connection member 31. Further, the legs 312 of the connection member 31 are respectively inserted through the position-limit holes 123 of the hinge 1, and then, a pivot pin 5 is inserted through the through holes 313 of the legs 312 and the second axle hole 221 of the second positioning member 22 of the bumper assembly 2 to pivotally connect the anti-drop device 3 to the second positioning member 22 of the bumper assembly 2, holding the position-limit end 122 of the hinge 1 between the friction pad 32 of the anti-drop device 3 and the second positioning member 22 of the bumper assembly 2.

Figure 11:
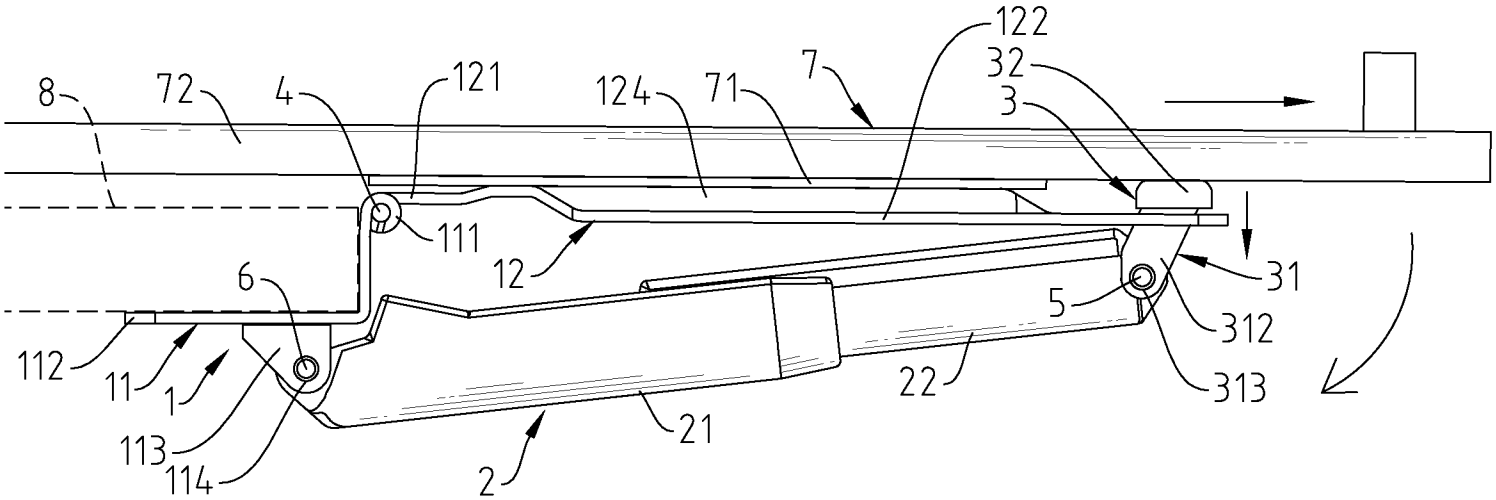
FIG. 11 is a schematic applied view of the anti-drop device of the anti-drop safety device assembly in accordance with the present invention (IV).
Figure 12:
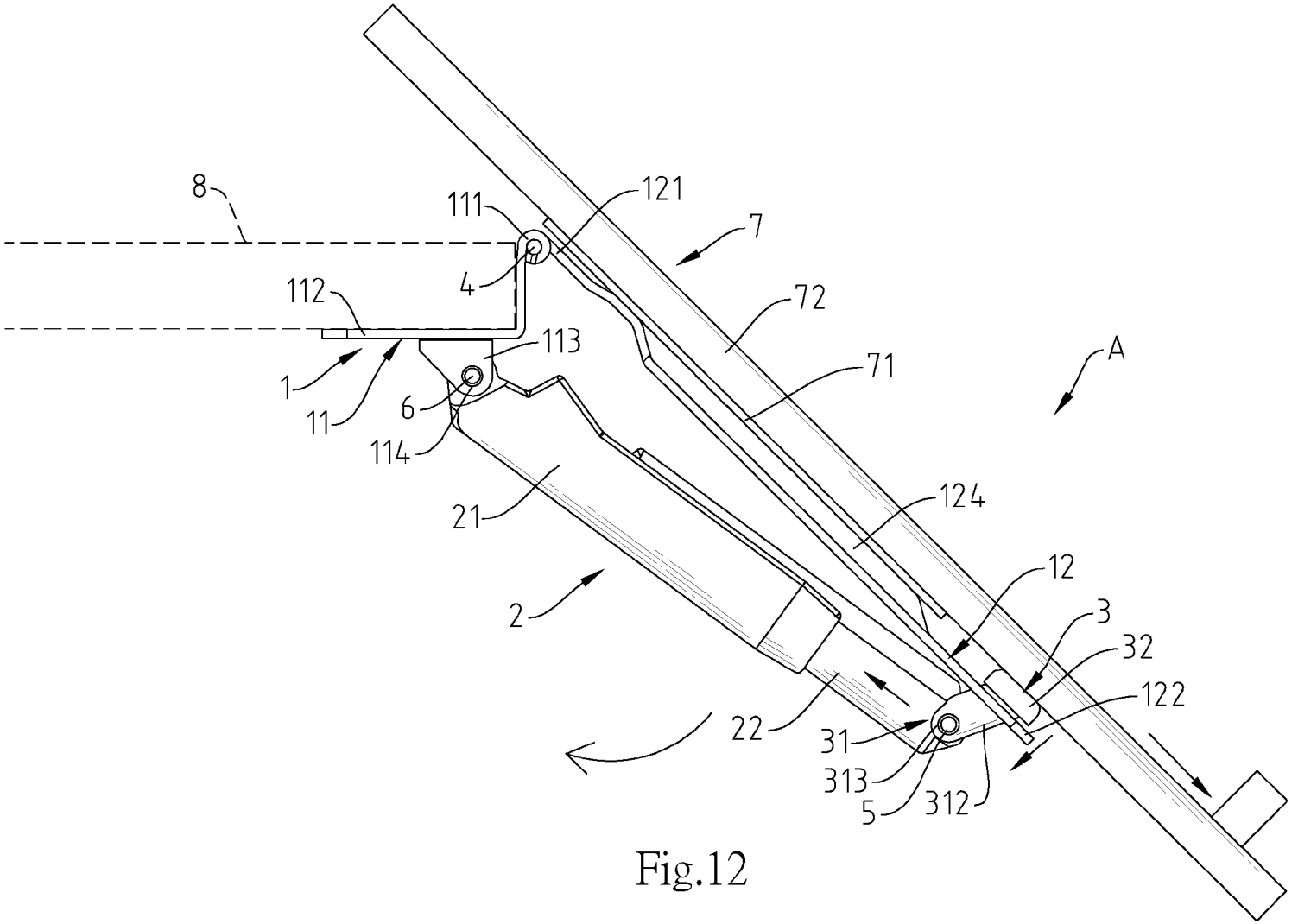
FIG. 12 is a schematic applied view of the anti-drop device of the anti-drop safety device assembly in accordance with the present invention (V).
Figure 13:
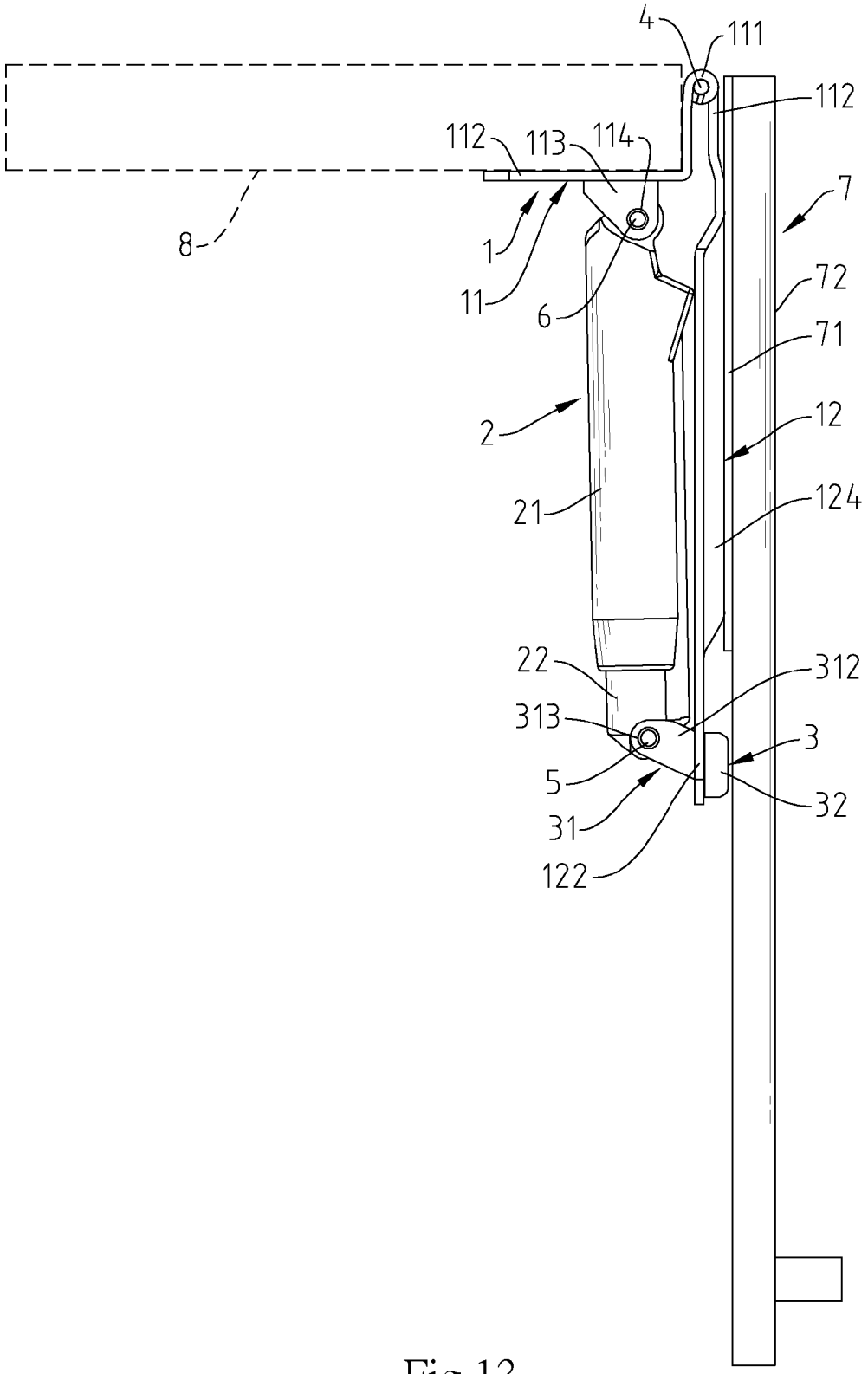
FIG. 13 is a schematic applied view of the anti-drop device of the anti-drop safety device assembly in accordance with the present invention (VI).

Referring to FIGS. 7-13 and FIGS. 3 and 4 again, the anti-drop safety device assembly of the invention is shown used in a flip door panel assembly 7 of a cabinet 8. The flip door panel assembly 7 comprises a sliding rail 71, and a flip door panel 72 slidably coupled to the sliding rail 71. In application, affix the first hinge plate 11 to the cabinet 8, and then connect the connection portion 124 of the second hinge plate 12 to the sliding rail 71 of the flip door panel assembly 7. When wishing to open the flip door panel 72 from the cabinet 8, as illustrated in FIGS. 7-10, pull the flip door panel 72 to bias the second hinge plate 12 relative to the first hinge plate 11. At this time, the position-limit end 122 of the second hinge plate 12 is moved toward the friction pad 32 of the anti-drop device 3 to enlarge the gap between the bottom wall of the flip door panel 72 and the friction pad 32, and then to pull the anti-drop device 3 in carrying the second positioning member 22 out of the first positioning member 21 and simultaneously stretching the bumper 23. If the flip door panel 72 is accidentally slipped from the user's hand as the user opening it, due to the supporting effect of the bumper 23, the flip door panel 72 will not drop suddenly. After the flip door panel 72 has been opened to a certain angle and suspended above the cabinet 8, the user can then push the flip door panel 72 along the sliding rail 71 to the inside of the cabinet 8. Because a gap will be left between the bottom wall of the flip door panel 72 and the friction pad 32 after the user turned the flip door panel 72 upward, the user can conveniently push the flip door panel 72 along the sliding rail 71 to the inside of the cabinet 8 conveniently at this time. Further, as illustrated in FIGS. 11-13, when the user wishes to move the flip door panel 72 out of the top side of the cabinet 8 and to close it on the cabinet 8, the user can pull the flip door panel 72 outwardly from the top side of the cabinet 8 and then turn it downwards to bias the second hinge plate 12 relative to the first hinge plate 11. At this time, the position-limit end 122 of the second hinge plate 12 will be moved in direction away from the friction pad 32 of the anti-drop device 3, causing the bottom wall of the door panel 72 to rub against the surface of the friction pad 32, thus, even if the flip door panel 72 is slipped from the user's hand at this time, the friction force between the flip door panel 72 and the friction pad 32 can prohibit the flip door panel 72 from dropping suddenly, assuring a high level of safety.

What is claimed is:

1. An anti-drop safety device assembly, comprising:

a hinge comprising a first hinge plate and a second hinge plate hinged together, said first hinge plate comprising a first pivot connection end and an opposing coupling end, said second hinge plate comprising a second pivot connection end pivotally connected with said first pivot connection end of said first hinge plate, an opposing position-limit end and a plurality of position-limit holes located at said position-limit end;

a bumper assembly comprising a first positioning member, a second positioning member and a bumper, said second positioning member being mounted in and movable in and out of said first positioning member, said bumper having two opposite ends thereof respectively connected to said first positioning member and said second positioning member, said first positioning member having one end thereof pivotally coupled to said coupling end of said hinge remote from said second positioning member; and an anti-drop device comprising a connection member and a friction pad located at a top side of said connection member, said connection member comprising a base supporting said friction pad and two legs respectively extended from two opposite lateral sides of said base in direction away from said friction pad and respectively inserted through said position-limit holes of said hinge and pivotally connected to said second positioning member of said bumper assembly remote from said first positioning member to hold said position-limit end of said hinge between said friction pad of said anti-drop device and said second positioning member of said bumper assembly.

2. The anti-drop safety device assembly as claimed in claim 1, wherein each said leg comprises a through hole located at a distal end thereof remote from said base; said second positioning member of said bumper assembly comprises a second axle hole located at one end thereof remote from said first positioning member and pivotally connected to the through holes of said legs of said connection member with a pivot pin to secure said connection member and said second positioning member pivotally together.

3. The anti-drop safety device assembly as claimed in claim 1, wherein said second hinge plate further comprises a connection portion connected between said second pivot connection end and said position-limit end fastened to a sliding rail of a flip door panel assembly, said flip door panel assembly comprising a flip door panel slidably coupled to said sliding rail.

* * * * *